US007055871B2

(12) United States Patent
Toledo et al.

(10) Patent No.: US 7,055,871 B2
(45) Date of Patent: Jun. 6, 2006

(54) ELECTRONIC DOOR LOCK DOGGING MECHANISM

(75) Inventors: George Toledo, Fallbrook, CA (US); Mark Warden, Upland, CA (US)

(73) Assignee: Jackson Corp., Los Angeles, CA (US)

( * ) Notice: Subject to any disclaimer, the term of this patent is extended or adjusted under 35 U.S.C. 154(b) by 0 days.

(21) Appl. No.: 10/890,609

(22) Filed: Jul. 14, 2004

(65) Prior Publication Data

US 2005/0012343 A1 Jan. 20, 2005

Related U.S. Application Data

(60) Provisional application No. 60/488,693, filed on Jul. 18, 2003.

(51) Int. Cl.
*E05C 1/06* (2006.01)

(52) U.S. Cl. ..... 292/144; 292/169; 292/333; 292/341.16; 70/131

(58) Field of Classification Search ..... 292/144, 292/152, 163, 169, 169.18, 341.15, 341.16, 292/254, 332–333; 70/131, 141–142, 144
See application file for complete search history.

(56) References Cited

U.S. PATENT DOCUMENTS 1,306,560 A 6/1919 Page
1,391,005 A 9/1921 Palmer
1,768,021 A 6/1930 Bauerband
1,948,217 A 2/1934 Goodwin, Sr.
2,637,578 A 5/1953 Gaona
2,765,648 A 10/1956 Hatcher
3,150,894 A 9/1964 Sant
4,071,271 A 1/1978 Bourrié et al.
4,099,752 A * 7/1978 Geringer ..... 292/144
4,478,444 A * 10/1984 Kurz et al. ..... 292/333
4,685,709 A 8/1987 Kambic
4,784,415 A 11/1988 Malaval
5,216,909 A * 6/1993 Armoogam ..... 292/144
5,386,713 A * 2/1995 Wilson ..... 292/144
5,474,342 A * 12/1995 Smith et al. ..... 292/254

(Continued)

*Primary Examiner*—Brian E. Glessner
*Assistant Examiner*—Christopher Boswell
(74) *Attorney, Agent, or Firm*—Sonnenschein Nath & Rosenthal LLP

(57) ABSTRACT

An electronic door lock dogging mechanism is provided with a bolt arranged to move into and out of a door to selectively engage a portion of a door frame to lock a door when extending out of the door and when recessed within the door, unlocking the door from the door frame. A first mechanical element is arranged to normally bias the bolt outwardly relative to the door. A first electrical element is arranged, when energized, to move the bolt into a recessed position in the door to unlock the door. A second mechanical element is arranged to be biased into a dogging position relative to the bolt when the first electrical element has moved the bolt into its recessed position. A third mechanical element is arranged to engage the second mechanical element to move it out of the dogging position when the third mechanical element is moved into a first position. A fourth mechanical element is arranged to bias the third mechanical element into the first position. The third mechanical element is arranged to move with the energization of the second electrical element to move the third mechanical element into a second position, moving the third mechanical element away from engagement with the second mechanical element. A second electrical element is arranged, when energized, to hold the third mechanical element in the second position.

17 Claims, 3 Drawing Sheets

U.S. PATENT DOCUMENTS 5,525,963 A 6/1996 Purssey
5,531,492 A * 7/1996 Raskevicius ..... 292/153
5,636,536 A * 6/1997 Kinnucan ..... 292/144
5,845,524 A * 12/1998 Koehler ..... 292/144
5,865,483 A 2/1999 Dubravin
5,943,888 A 8/1999 Lawson
5,988,708 A 11/1999 Frolov et al.
6,022,056 A * 2/2000 Cope et al. ..... 292/144
6,079,755 A * 6/2000 Chang ..... 292/144
6,601,418 B1 * 8/2003 Huang ..... 292/144
6,863,317 B1 * 3/2005 Alton et al. ..... 292/144
2002/0074810 A1 6/2002 Spurr

* cited by examiner

ELECTRONIC DOOR LOCK DOGGING MECHANISM

This application claims benefit of Provisional Application No. 60/488,693, filed Jul. 18, 2003.

BACKGROUND OF THE INVENTION

The present invention relates to an electronic door lock dogging mechanism to be used with an emergency door latching system.

SUMMARY OF THE INVENTION

Emergency door latching systems are well known, such as those disclosed in U.S. Pat. Nos. 5,322,332 and 4,839,988, which disclosures are incorporated herein by reference.

As shown in FIG. 2, when a door 20 is closed and locked, a bolt 22 extends vertically through a plate 24 secured to a transom header 26. The bolt 22 also extends through a hole 28 in a trigger 30 (second mechanical element). There the trigger 30 is spring loaded and biased to the left, but is pushed to the right when the door 20 is closed, to align the hole 28 with the bolt 22. To open the door 20, pressure is applied to the door release mechanism (not illustrated), retracting the bolt 22 downwardly against the force of a spring 32 (first mechanical element). When the door 22 is open (FIG. 1), the trigger 30 is pushed to the left by a spring 34 such that the hole 28 in the trigger 30 will move to the left and will block the bolt 22 from moving upwardly (dog the bolt), even though pressure on the door release mechanism may be removed. This is shown in FIG. 1. This will allow the door 20 to swing back closed without the bolt 22 hitting the transom 26. As soon as the door 20 is nearly completely closed, a nose 36 of the trigger 30 will engage the door frame stile 38, pushing the trigger 30 to the right, and releasing the bolt 22. The bolt spring 32 will push the bolt 22 upwardly through the trigger 30 and the plate 24, into the transom 26, relocking the door 20.

DETAILED DESCRIPTION OF THE PREFERRED EMBODIMENT

Figure 1:
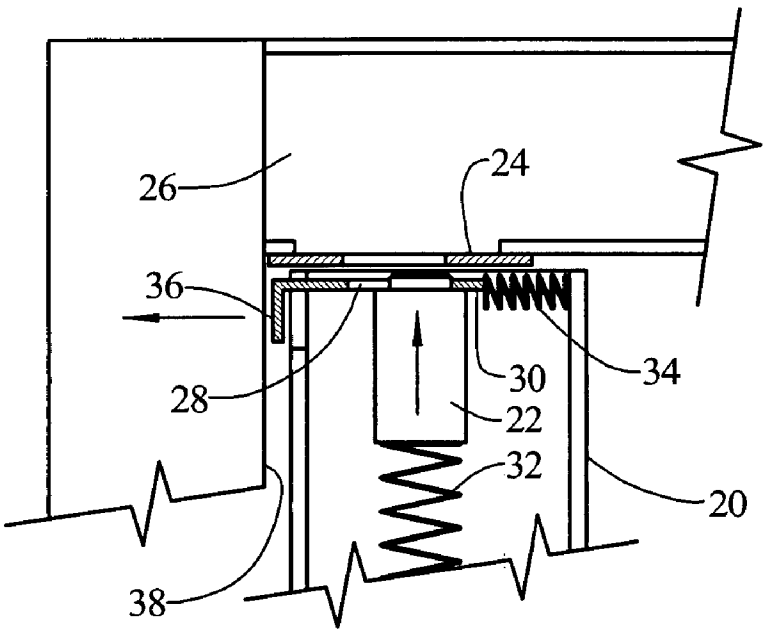
FIG. 1 PRIOR ART
FIG. 1 schematically illustrates a prior art construction being a cross sectional view of the door, at the top and near the free edge, and looking in the direction from the free edge towards the hinge, with the bolt in the dogged position.
Figure 3:
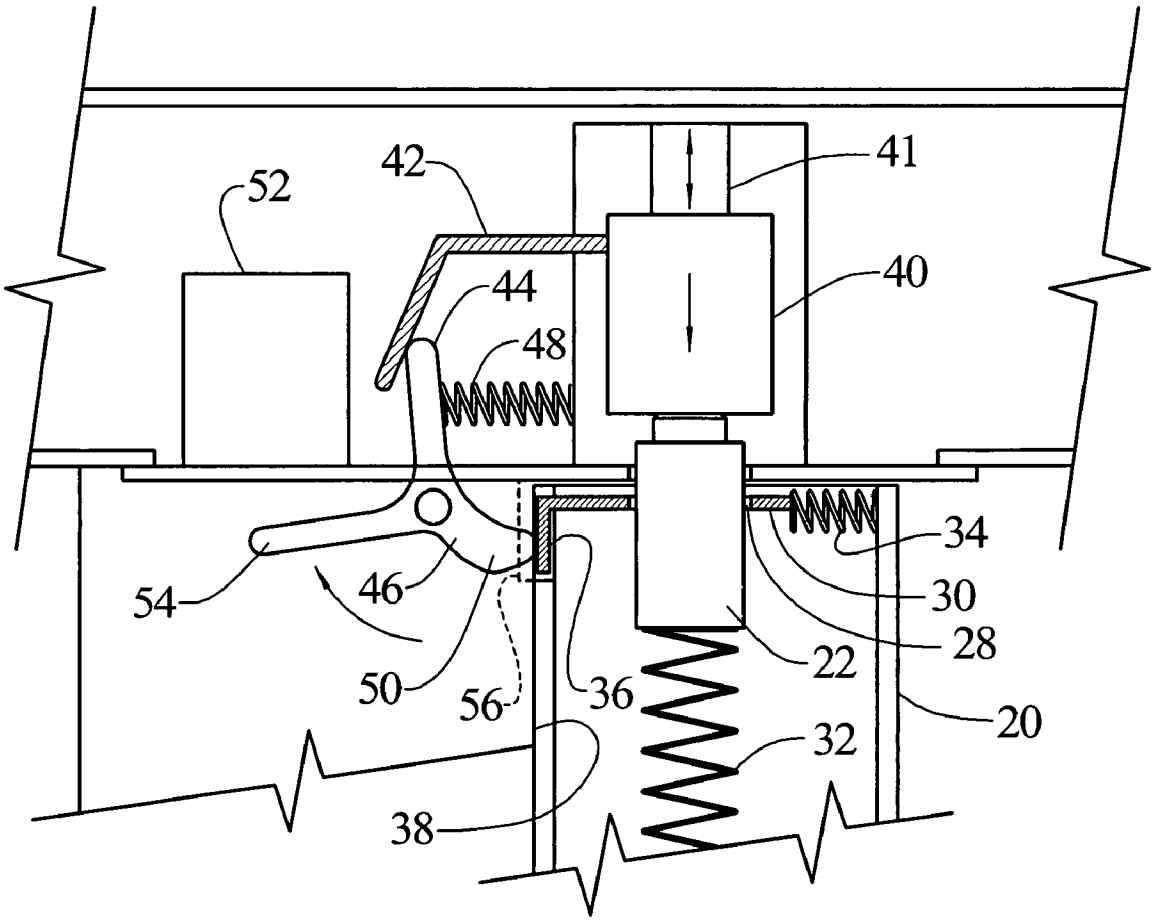
FIG. 3 schematically illustrates a first embodiment of an electronic door lock dogging mechanism embodying the principles of the present invention in a cross-sectional view of the door, at the top and near the free edge, and looking in the direction from the free edge toward the hinge, with the bolt in the extended position.

As illustrated in FIG. 3, an embodiment of the present invention uses an electronic mechanism to unlock the door 20, and to allow the bolt 22 to remain in the unlocked (dogged) position, even if the door is closed. Power is provided to a solenoid 40 (first electrical element) with a vertically movable piston 41 to drive the bolt 22 vertically downwardly against its spring 32. The solenoid 40 has an actuator 42 that moves downwardly, simultaneously with movement of the solenoid piston. The solenoid actuator 42 engages a vertical arm 44 of a pivoted cam 46 (third mechanical element), causing the cam 46 to rotate, from a first position clockwise against a cam spring 48 (fourth mechanical element). A substantially horizontal arm 50 of the cam 40 is rotated upwardly to a second position into the proximity of an electro magnet 52 (second electrical element), which is energized. When the cam 46 rotates, an extending lobe 54 of the cam 46 moves away from engagement with the nose 36 of the trigger 30, allowing the trigger spring 34 to cause the trigger 30 to move to the left, once the bolt 22 has moved down. This will "misalign" the trigger hole 28 with the bolt 22, allowing the bolt to be held in the downward position (dogged), as in FIG. 1. The power to the solenoid 40 can then be removed, and only the smaller power to the electro magnet 52 will remain. The door 20, even when in the closed position, will remain unlocked, in that the nose 36 of the trigger 30 will be received in a recess 56 in the door frame stile 38 normally occupied by the cam lobe 54.

Figure 2:
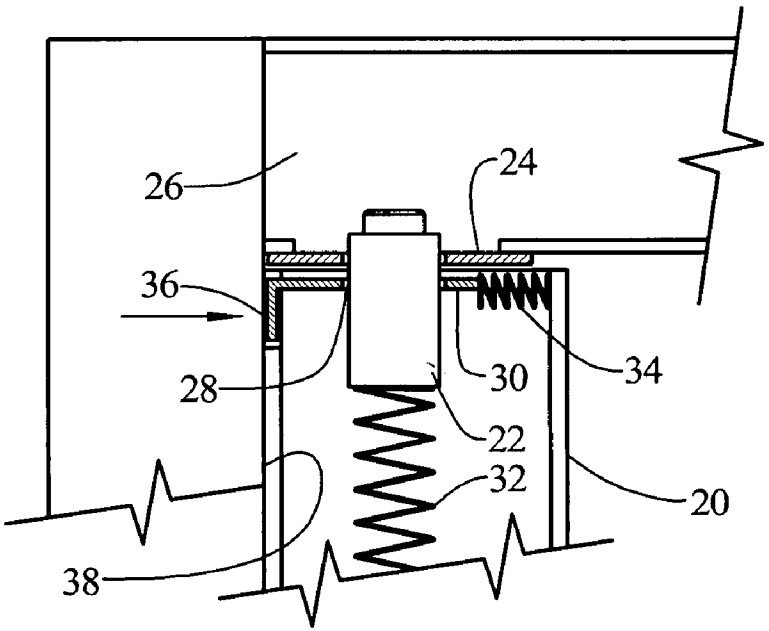
FIG. 2 PRIOR ART
FIG. 2 schematically illustrates a prior art construction being a cross sectional view of the door, at the top and near the free edge, and looking in the direction from the free edge towards the hinge, with the bolt in the extended, locking position.

When it is desired to relock the door 20, power is removed from the electro magnet 52, and the cam 46 is rotated by cam spring 48 to press the cam lobe 54 against the nose 36 of the trigger 30, releasing the bolt 22 and allowing it to move upwardly as biased by its spring 32 into the locked position of FIG. 2.

Figure 4:
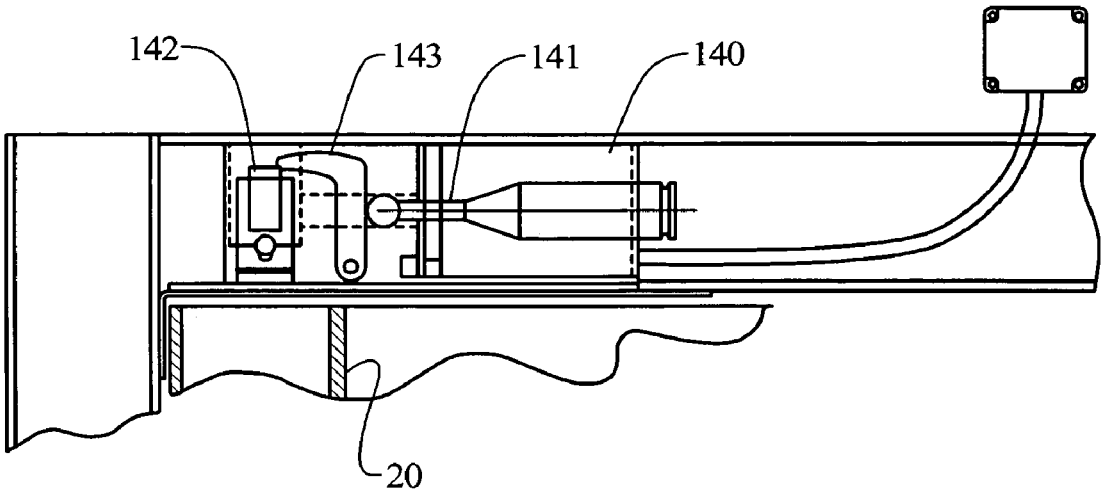
FIG. 4 schematically illustrates a second embodiment of an electronic door lock dogging mechanism embodying the principles of the present invention in a partial cross- sectional view of the door frame, at the top and near the free edge of the door, and looking at the face of the closed door.
Figure 5:
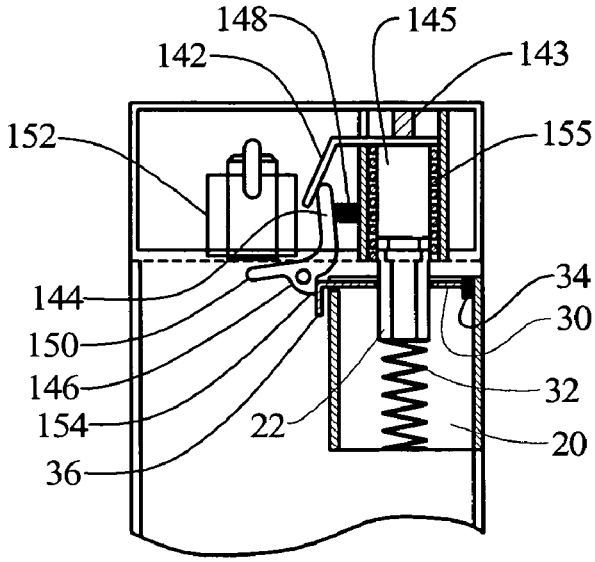
FIG. 5 schematically illustrates the second embodiment of the electronic door lock dogging mechanism of FIG. 4 in a cross-sectional view of the door, at the top and near the free edge, and looking in the direction from the free edge towards the hinge, with the bolt in the extended, locking position.

As illustrated in FIGS. 4 and 5, a second embodiment of the present invention uses a similar electronic mechanism to unlock the door 20, and to allow the bolt 22 to remain in the unlocked (dogged) position, even if the door is closed. Power is provided to a solenoid 140 (first electrical element) to drive the bolt 22 downwardly against its spring 32. The solenoid 140 has a horizontally movable piston 141 which presses against a pivoted push arm 143 that provides a downward force on an actuator 142 carried on a vertically movable piston as the solenoid piston 141 moves outwardly relative to the solenoid 140. The actuator 142 engages a vertical arm 144 of a pivoted cam 146 (third mechanical element), causing the cam 146 to rotate, from a first position clockwise against a cam spring 148 (fourth mechanical element). A substantially horizontal arm 150 of the cam 140 is rotated upwardly to a second position into the proximity of an electro magnet 152 (second electrical element), which is energized. When the cam 140 rotates, an extending lobe 154 of the cam 140 moves away from engagement with the nose 36 of the trigger 30, allowing the trigger spring 34 to cause the trigger 30 to move to the left, once the bolt 22 has moved down. This will "misalign" the trigger hole 28 with the bolt 22, allowing the bolt to be held in the downward position (dogged), as in FIG. 1. The power to the solenoid 140 can then be removed, and only the smaller power to the electro magnet 152 will remain. When the solenoid 140 is deenergized, the piston 141 will retract and a compression spring 155 will cause the vertically movable piston 145 to move upwardly, thereby moving the actuator 142 away from the vertical arm 144 of the cam 146. The door 20, even when in the closed position, will remain unlocked, in that the nose 36 of the trigger 30 will be received in the recess in the door frame stile 38 normally occupied by the cam lobe 154.

When it is desired to relock the door 20, power is removed from the electro magnet 152, and the cam 146 is rotated to press the cam lobe 154 against the nose 36 of the trigger 30, releasing the bolt 22 and allowing it to move upwardly as biased by its spring 32 into the locked position of FIG. 2.

The various mechanical end electrical elements can be provided in other forms than those described in the particular embodiment illustrated. For example, the first mechanical element may comprise other types of springs than the compression spring illustrated, including expansion springs, hydraulic and pneumatic cylinders, and other known energy storage devices. The second mechanical element may be different than the slidable trigger illustrated, including a pivotable member, a member that engages only a portion of the bolt, rather than surrounding the bolt with a hole, a member that engages a sidewall rather than the end wall of the bolt, and other similar variations. The third mechanical element may be different than the rotatable cam illustrated, including a slidable member to engage and disengage with the second mechanical element, it may be biased with other than a compression spring, as in the first mechanical element, the arms may be configured differently than shown, or replaced altogether with other elements to effect the necessary movements and restraints. The fourth mechanical element may be different than the compression spring illustrated, including expansion springs, hydraulic and pneumatic cylinders, and other known energy storage devices. The first electrical element may be different than the solenoid illustrated, including hydraulic and pneumatic cylinders, wax motors, motor driven screws or racks and other known electrically extendable and retractable devices. The second electrical element may be different than the electro magnet illustrated, including other known electrically powered latches and catches for holding the third mechanical element. The arrangement illustrated may be applied at the top of the door as shown, and/or at the bottom of the door, or arranged at 90 degrees to the orientation illustrated to have the bolt extend essentially horizontally into the door stile or other portion of the door frame.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

What is claimed is:

1. An electronic door lock dogging mechanism comprising:

a bolt arranged to move into and out of a door to selectively engage a portion of a door frame to lock a door when extending out of the door and when recessed within the door, unlocking the door from the door frame, a bolt spring arranged to normally bias the bolt outwardly relative to the door, a solenoid arranged, when energized, to have movement of a solenoid piston move the bolt into a recessed position in the door to unlock the door, a trigger arranged to be biased into a dogging position relative to the bolt when the solenoid has moved the bolt into its recessed position, a rotatable cam having a cam lobe arranged to engage the trigger to move it out of the dogging position when the cam is rotated into a first position, a biasing spring arranged to bias the cam into the first position, a solenoid actuator arranged to move with the movement of the solenoid piston to rotate the cam into a second position, moving the cam lobe away from engagement with the trigger, an electromagnet arranged, when energized, to hold the cam in the second position.

2. An electronic door lock dogging mechanism according to claim 1, wherein said solenoid piston moves vertically to move said bolt vertically in said door.

3. An electronic door lock dogging mechanism according to claim 1, wherein said solenoid piston moves horizontally to move said bolt vertically in said door.

4. An electronic door lock dogging mechanism according to claim 3, wherein said solenoid piston moves against a pivoted push arm to move said bolt.

5. An electronic door lock dogging mechanism according to claim 4, wherein said push arm provides a vertical force against a vertically movable piston, which in turn engages said bolt.

6. An electronic door lock dogging mechanism according to claim 5, wherein said vertically movable piston is biased upwardly by a spring.

7. An electronic door lock dogging mechanism comprising:

a bolt arranged to move into and out of a door to selectively engage a portion of a door frame to lock a door when extending out of the door and when recessed within the door, unlocking the door from the door frame, a first mechanical element arranged to normally bias the bolt outwardly relative to the door, a first electrical element arranged, when energized, to move the bolt into a recessed position in the door to unlock the door, a second mechanical element arranged to be biased into a dogging position relative to the bolt when the first electrical element has moved the bolt into its recessed position, a third mechanical element arranged to engage the second mechanical element to move it out of the dogging position when the third mechanical element is moved into a first position, a fourth mechanical element arranged to bias the third mechanical element into the first position, the third mechanical element arranged to move with the energization of the second electrical element to move the third mechanical element into a second position, moving the third mechanical element away from engagement with the second mechanical element, a second electrical element arranged, when energized, to hold the third mechanical element in the second position.

8. The electronic door lock dogging mechanism of claim 7, wherein the first mechanical element comprises a spring.

9. The electronic door lock dogging mechanism of claim 7, wherein the first electrical element comprises a solenoid.

10. The electronic door lock dogging mechanism of claim 7, wherein the second mechanical element comprises a slidable trigger.

11. The electronic door lock dogging mechanism of claim 7, wherein the third mechanical element comprises a rotatably mounted cam.

12. The electronic door lock dogging mechanism of claim 7, wherein the fourth mechanical element comprises a spring.

13. The electronic door lock dogging mechanism of claim 7, wherein the second electrical element comprises an electro magnet.

14. An electronic door lock dogging mechanism comprising:

a bolt arranged to move into and out of a door to selectively engage a portion of a door frame to lock a door when extending out of the door and when recessed within the door, unlocking the door from the door frame, a first mechanical element arranged to normally bias the bolt outwardly relative to the door, a solenoid arranged, when energized, to move the bolt into a recessed position in the door to unlock the door, a second mechanical element arranged to be biased into a dogging position relative to the bolt when the first electrical element has moved the bolt into its recessed position, a rotatably mounted cam arranged to engage the second mechanical element to move it out of the dogging position when the third mechanical element is moved into a first position, a fourth mechanical element arranged to bias the third mechanical element into the first position, the third mechanical element arranged to move with the energization of the second electrical element to move the third mechanical element into a second position, moving the third mechanical element away from engagement with the second mechanical element, an electro magnet arranged, when energized, to hold the third mechanical element in the second position.

15. The electronic door lock dogging mechanism of claim 14, wherein the first mechanical element comprises a spring.

16. The electronic door lock dogging mechanism of claim 14, wherein the second mechanical element comprises a slidable trigger.

17. The electronic door lock dogging mechanism of claim 14, wherein the fourth mechanical element comprises a spring.

* * * * *